United States Patent [19]

Lavorel

[11] Patent Number: 4,914,936

[45] Date of Patent: Apr. 10, 1990

[54] FOLLOW-ON TOOL FOR STAMPING PRESS

[75] Inventor: Gerard Lavorel, Pringy, France

[73] Assignee: Ateliers de Decoupage Emboutissage Et Mecanique de la Vallee de L'Arve ADEMVA, Cluses, France

[21] Appl. No.: 293,138

[22] Filed: Jan. 3, 1989

[30] Foreign Application Priority Data

Jan. 4, 1988 [FR] France ..... 88 00222

[51] Int. Cl.[4] ..... B21D 45/08

[52] U.S. Cl. ..... 72/345; 72/361

[58] Field of Search ..... 72/345, 349, 361, 404

[56] References Cited

U.S. PATENT DOCUMENTS 2,539,807 1/1951 Brandes ..... 72/349
3,368,383 2/1968 Marszal ..... 72/361
3,478,563 11/1969 Bozek ..... 72/361
3,939,685 2/1976 Hortig ..... 72/361

FOREIGN PATENT DOCUMENTS 2743642 9/1977 Fed. Rep. of Germany .
84138602 5/1984 Fed. Rep. of Germany .
2038690 11/1978 United Kingdom .

*Primary Examiner*—Lowell A. Larson
*Attorney, Agent, or Firm*—Emch, Schaffer, Schaub & Porcello Co.

[57] ABSTRACT

A follow-on tool to equip a stamping press for making deep-drawn products. A metal strip is associated with elastic support devices. A rigid intermediate plate, vertically mobile between two stops, carries centering and extraction tubes.

4 Claims, 4 Drawing Sheets

FOLLOW-ON TOOL FOR STAMPING PRESS

BACKGROUND OF THE INVENTION

1. Field of the Invention

This invention relates to a follow-on tool for a stamping press.

2. The Prior Art

Series production of very deep drawn products, with a depth greater than or equal to 1.5 times the diameter, is generally performed with a transfer press. It is a specially designed press to assure transfer, at each rising of the press slide, of each stamped product to the next station. A press of this type is very expensive because of its complexity, and further it allows only one row of pieces to be processed at a time.

Another mode of working consists in using a simple press, much less expensive, which is provided with follow-on tools able to perform the successive stamping phases. In this case the stamped products are shaped in one or more parallel rows from a metal strip which is fed along the axis of the machine. In this case, the strip itself supports the stamped products and, by progressively advancing, acts as an element for transfer from one station to the next. This more costly mode of working unfortunately is not applicable for making very deep-drawn products, as designated above, because the pieces, which are held only by thin metal strands on the strip, have a tendency to move crosswise.

SUMMARY OF THE INVENTION

The present invention, which aims in remedying this drawback, has as its object a follow-on tool which allows making of very deep drawn products, while using a regular press and a feed consisting of a metal strip.

This follow-on tool is of the type comprising, in a way known in the art, and for each unit stamping station, a punch carried by the upper base plate of the tool, which is fastened to the press slide, and also comprising a lower base plate, fastened to the press table, which carries a die-holding plate, each vertical stamping orifice comprising a vertical piston thrust upward by an elastic repulsion device such as a cylinder. This tool is equipped with two additional features.

Means for supporting the metal strip is placed on the transverse direction, on both sides of each prestamped product, which product is plumb with the punch and the stamping orifice of the corresponding die, and on the bottom of this prestamped product in this position. These three support means are slightly thrust elastically upward and are vertically retractable by a pressure exerted downward.

Means for vertical support on the strip are provided for centering the prestamped product and for extraction of the stamped product during rising of the punch. This vertical support means is constituted by a horizontal rigid plate, which is free to move vertically between two stops while being elastically thrust upward. This rigid plate is placed between said strip and the upper base plate of the tool and carries an element of vertical elastic support against the upper base plate which is thrust very strongly upward. This same rigid plate further comprises, for each stamping station, a vertical centering tube directed downward which is able to be passed through, with close sliding, by the punch during the descent of the punch, and to come to fit closely in said prestamped product when this rigid plate descends under the pressure of the base plate on said support element. This rigid plate finally comprises vertical projections directed downward which are able to come to rest on each of said support means of the strip placed on both sides of the prestamped products.

Further according to an advantageous characteristic, this follow-on tool is such that the piston body, placed in the stamping orifice, is hollow and constitutes the body of a singleaction cylinder fed by an orifice which puts the chamber of this cylinder in communication with the space located under this piston and fed with compressed fluid, the free end of the rod of this cylinder carrying the means for supporting the bottom of the prestamped product.

Preferably, the means for supporting the strip, placed on both sides of the prestamped product, consist of horizontal and longitudinal bars which are mounted at the free end of the vertical rods of the cylinder, arranged in the body of the lower base Advantageously, in this case the die-holding plate is provided with longitudinal notches able to serve as housings for the bars when they are in low position.

Still other objects, features and attendant advantages of the present invention will become apparent to those skilled it the art from a reading of the following detailed description of the embodiments constructed in accordance therewith, taken in conjunction with the accompanying drawings.

BRIEF DESCRIPTION OF THE DRAWINGS

In any case, the invention will be better understood and its advantage and other characteristics will come out during the following description of a nonlimiting example of embodiment, with reference to the accompanying diagrammatic drawings in which.

DETAILED DESCRIPTION OF THE PREFERRED EMBODIMENTS

Figure 1:
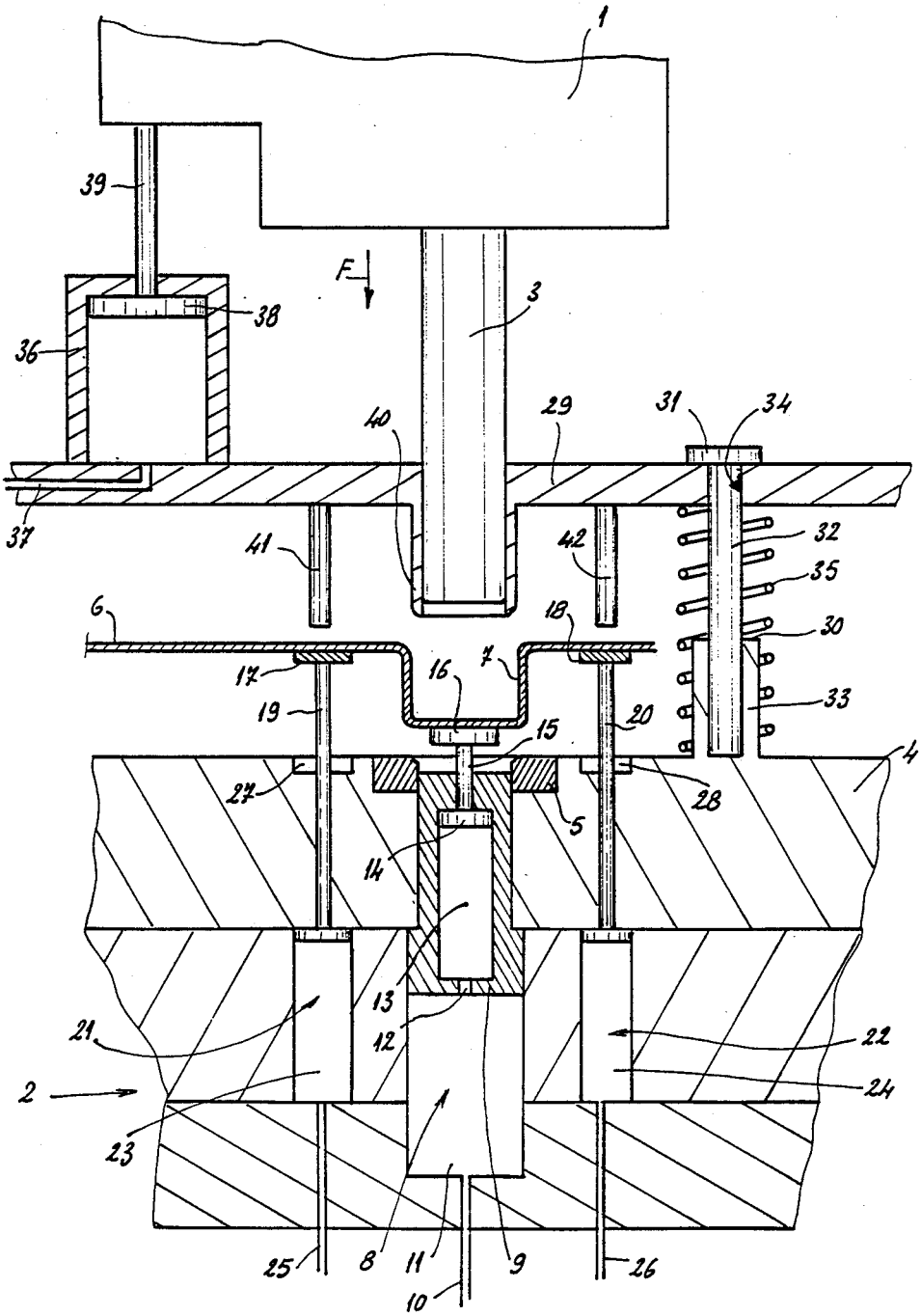
FIG. 1 is a partial crosswise section view of this follow-on tool with the press slide a high position.

First, referring to FIG. 1, the follow-on tool for the press comprises an upper base plate 1, fastened to the press slide (not represented) and a lower base plate 2, fastened to press table (also not shown).

Base plate 1 carries a plurality of punches 3, one punch per elementary stamping station. For example, for each stamping station there are three identical punches aligned in the transverse direction.

Figure 2:
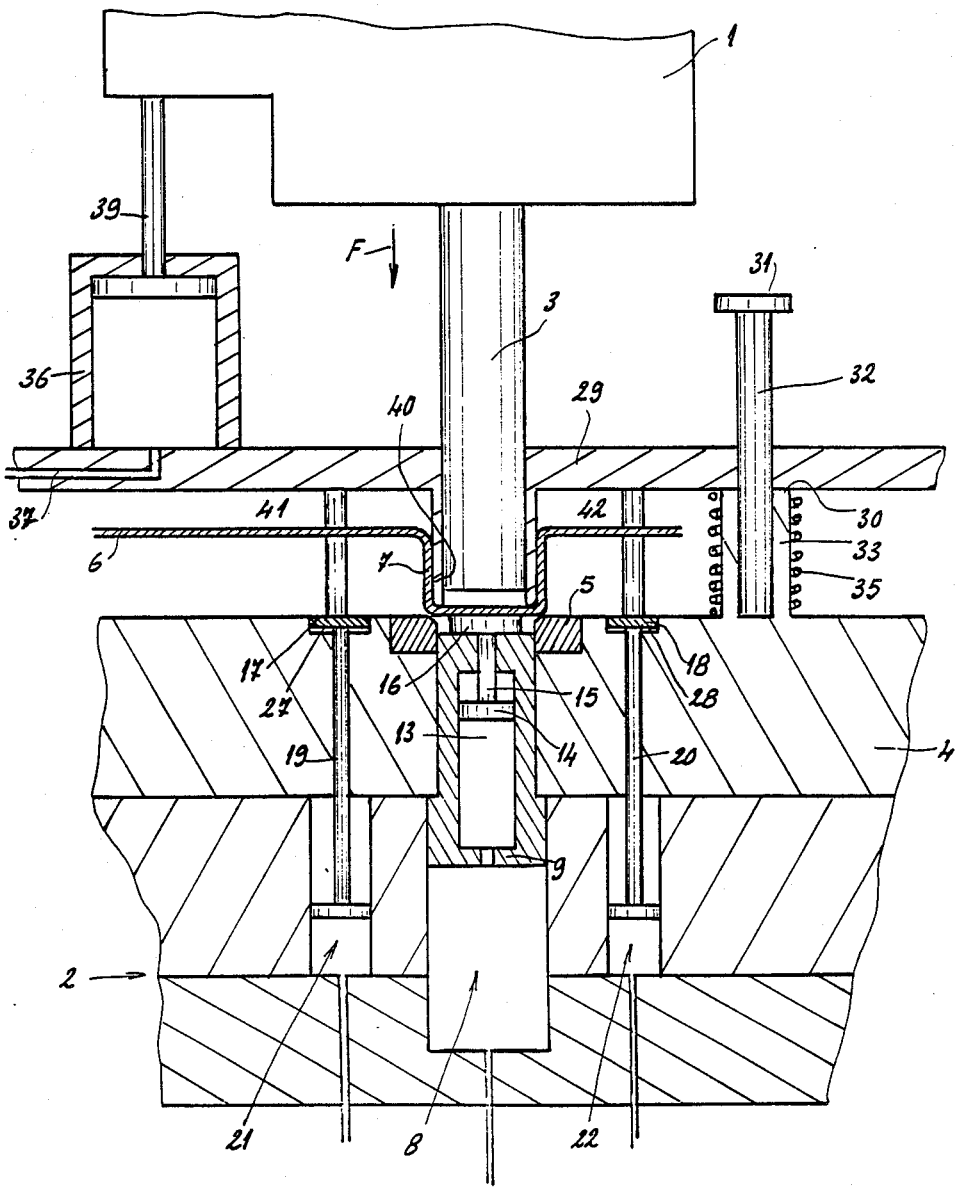
FIG. 2 is a view similar to FIG. 1, but showing the descent phase of the slide which precedes the stamping.

A plate 4 carrying dies 5 is fastened to lower base plate 2. As required, each die 5 is placed plumb with an associated punch 3, to work with it, during the descent of the slide, to perform the stamping. Metal strip 6 6o be stamped is fed longitudinally step by step, i.e., from front to back in the drawing. FIG. 2 shows a stamping station which is not the first station, so that a "prestamped product" 7, in the form of a cup, is presented at this station vertically plumb to punch 3.

Vertically plumb to each punch 3, base plate 2 and plate 4 are passed through by a blind vertical stamping orifice 8 which, in a standard way, has a diameter slightly greater than that of punch 3. This orifice 8 contains, still in a way known in the art, a piston 9 with a vertical slide which is elastically thrust upward by air pressure applied by duct 10, to lower part 11 of blind hole 8 (unit 8 to 10 actually make a pneumatic cylinder).

According to a first characteristic of the invention piston 9 is hollow and constitutes the body of a single-action pneumatic cylinder, which is fed compressed air by a lower orifice 12 putting chamber 13 of this cylinder in communication with predefined space 11. This cylinder comprises a piston 14 and a rod 15, whose free end carries a horizontal disk 16 on which the bottom of prestamped product 7 rests, as can be seen in FIG. 1. It should be noted that with these arrangements, the pressure exerted upward on piston 14 is rather weak.

Horizontal disk 16 therefore acts as a support for prestamped product 7. Other elastic support elements are provided, on both side of each prestamped product 7, to assure perfect support of strip 6. In the example represented, these other support elements consist of two horizontal longitudinal bars 17, 18, mounted at the free end of vertical rods 19, 20 of two pneumatic cylinders 21, 22 which are arranged, as represented, in the body of lower base plate 3. Chambers 23, 24 of these cylinders 21, 22 are fed, under relatively slight pressure, compressed air by ducts 25 and 26. Two longitudinal notches 27 and 28 are provided in plate 4 to receive bars 17 and 18 when the rods 19, 20 are in the low position, with rods 19 and 20 retracted into chambers 23, 24 of cylinders 21 and 22.

For the case where strip 6 comprises three longitudinal, parallel rows of stamped products and prestamped products 7, the tool comprises four support bars 17 and 18. More generally, for n rows of prestamped products 7, there will be n+1 support bars 17, 18.

According to another characteristic of the invention, this tool comprises a horizontal longitudinal plate 29, rigid and thick, with a width approximately equal to or slightly greater than that of strip 6, this plate being free to move vertically between a lower stop 30, consisting of a projection 33 from plate 4, and an upper stop 31 consisting of a disk 31 carried by a small vertical column 32 stationary in projection 33.

Plate 29 is pierced with an orifice 34 for passage of the small column 32. There are several small columns 32 that are distributed on plate 4 to guide, in vertical sliding, plate 29. The elastic support of the plate 29 is provided and assured by helical springs 35 which surround each guide column 32 and which tend to thrust plate 29 upward.

Rigid plate 29, which is placed between strip 6 and upper base plate 1, carries a vertical pneumatic cylinder 36 which is fed under air pressure by a duct 37. Piston 38 of this cylinder therefore is thrust upward, and upper base plate 1 comes to rest on the free end of its rod 39 to make plate 29 descend when the press slide begins its descent.

For each unit stamping station (by "unit stamping station" is understood the elementary stamping station consisting of a determined punch 3 and a die 5), rigid plate 29 comprises a vertical, cylindrical centering tube 40, directed downward and whose relatively slight length is slightly greater than the depth of prestamped product 7. This tube 40 is placed vertically plumb with the prestamped product, into which it is able to penetrate to assure its centering, and it should also provide passage to punch 3 during its vertical movement. This centering tube 40 therefore has an outside diameter approximately equal to the inside diameter of prestamped product 7, except for the play which allows its sliding in this prestamped product 7, and its inside diameter is approximately equal to the diameter of cylindrical punch 3, here also except for the play which allows sliding of this punch in this tube 40.

On both sides, in the transverse direction, of each centering tube 40, plate 29 is equipped with projections 41, 42, which are directed downward and which are vertically plumb with support bars 17 and 18. These projections 41, 42 have a length approximately equal to or slightly greater than that of centering tube 40, and are intended to press on disks 17, 18 to put them in motion in response to the descending movement imparted by the press slide to upper base plate 1 and, by support cylinder 36, to rigid plate 29.

The functioning of this tool will now be described with the aid of FIGS. 1 to 4.

Starting from the high position of FIG. 1, the press slide begins its descent, carrying base plate 1 in the direction of arrow F. This base plate 1 comes to press on the free end of rod 39 of cylinder 36, but this rod is not depressed because the pressure exerted upward on piston 38 is much greater than that exerted upward on plate 29 by the unit of springs 35. These springs 35 therefore give way and plate 29 descends with base plate 1 and punch 3. In its descending movement, plate 29 puts into motion, when projections 41, 42 have come to rest on bars 17 and 18, rods 19 and 20 of cylinders 21 and 22, so that the strip 6 also descends, further causing the concomitant descent of disk 16, because the pressure exerted on piston 14 is rather weak.

FIG. 2 shows the position obtained by the various elements when plate 29 has come to rest on lower stop 30: stops 15,19 and 20 of three cylinders 8, 21 and 22 are retracted to the maximum, i.e., support disks 17 and 18 have retracted to housing 27 and 28, while support disk 16 rests on the upper face, then slightly retracted, of piston 8. Centering tube 40 at this stage has moved to the bottom of prestamped product 7.

Figure 3:
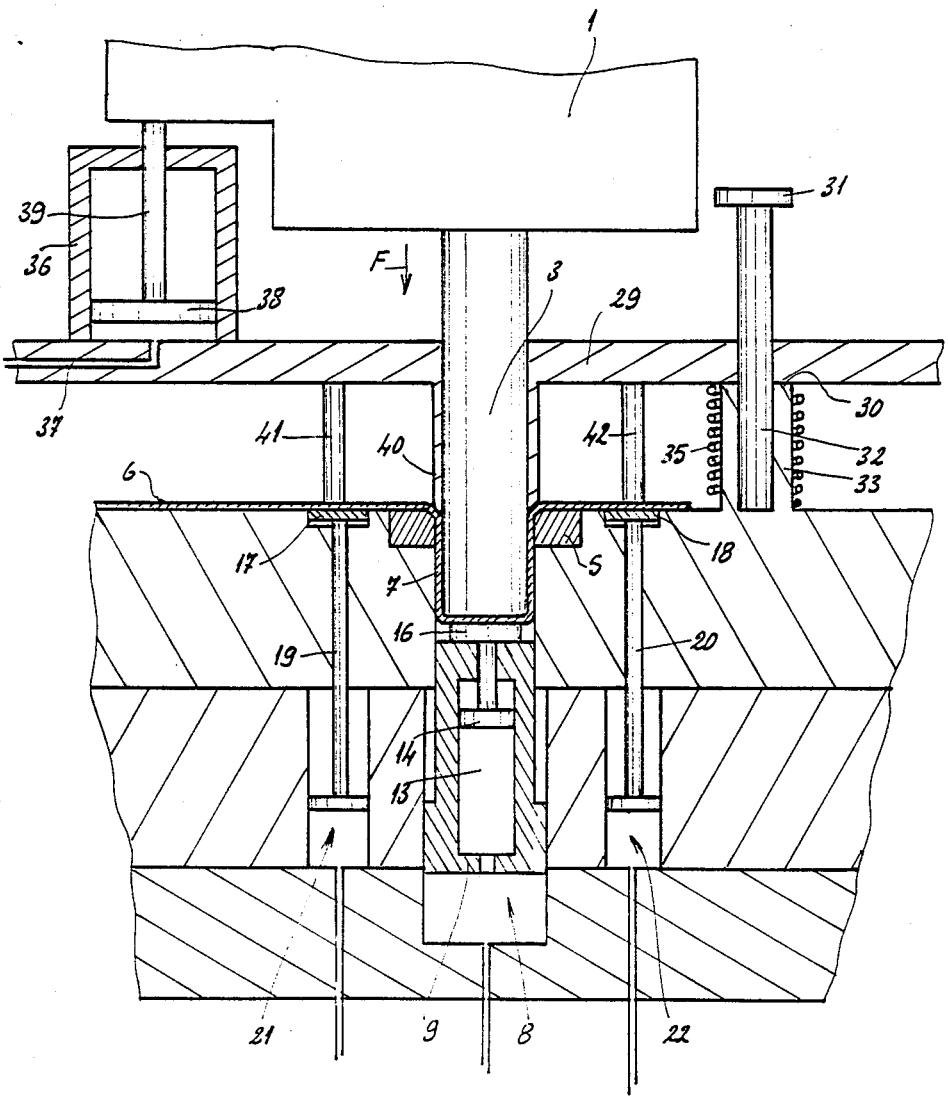
FIG. 3 shows in the same way the following and final phase of the descent of the slide, a phase during which the actual stamping takes place.

Starting from the position of FIG. 2, plate 29 can no longer descent. As the slide, and therefore base plate 1, continues its descending travel, base plate 1 sinks rod 39 into the body of cylinder 36, while punch 3 penetrates, as represented in FIG. 3, into die 5, performing the stamping of piece 7, which thereby contracts in diameter and increases in length. During this movement, piston 9 of cylinder 8 is pressed downward, and it follows the descending movement of punch 3. The position of FIG. 3 corresponds approximately to the bottom dead center of the slide.

Figure 4:
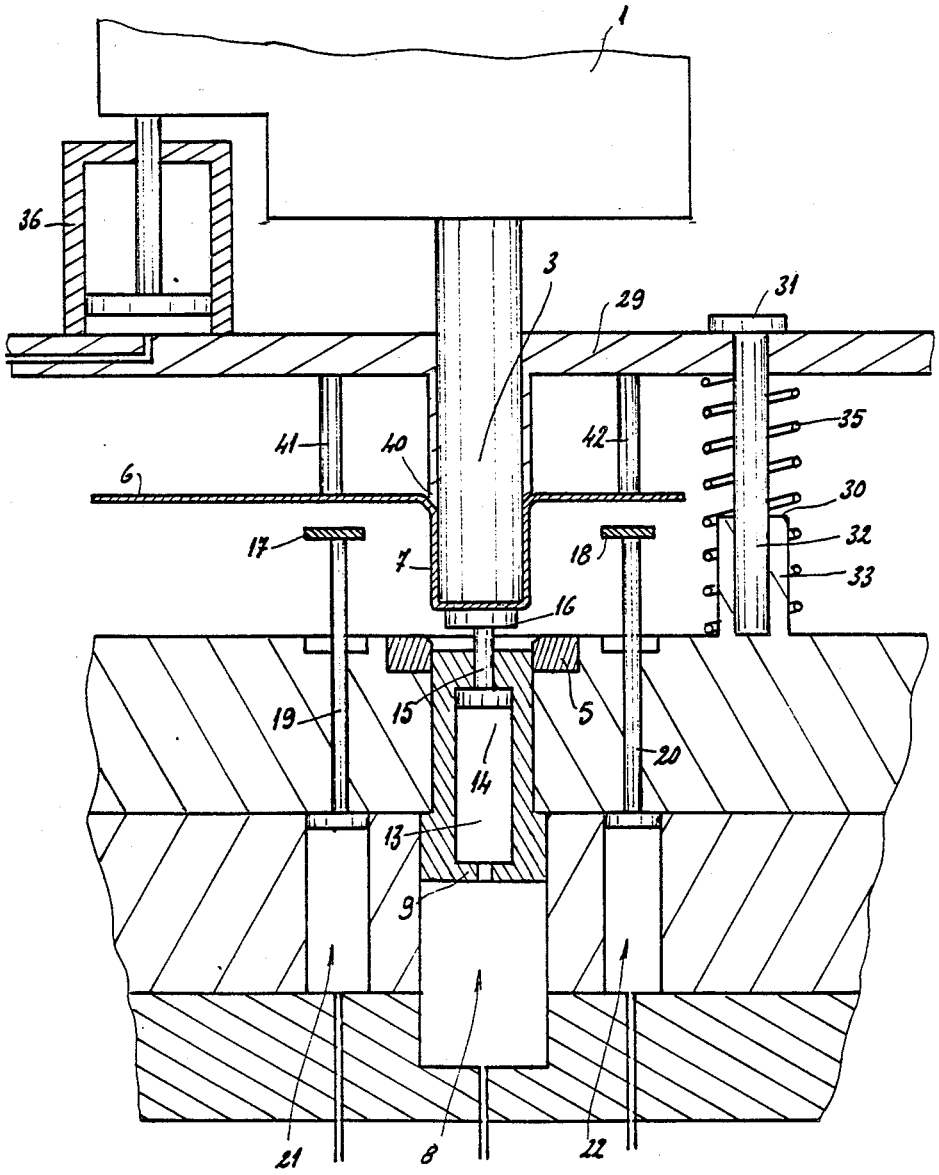
FIG. 4 also shows the rising of the slide, with extraction of the stamped product.

The rising phase of the slide is schematically represented in FIG. 4. Stamped products 7 all very tightly hug punches 3, so that strip 6 rises with punch 3, carrying with it centering tubes 40 and therefore rigid plate 29. The latter then comes to rest against its upper stops at end of travel 13 (position of FIG. 4) which stops its ascent.

Punch 3 continuing its rise, and tubes 40 not as extractors for stamped products 7 so that the punches leave stamped products 7 when support bars 17, 18 have returned to the high position.

At the top dead center of the slide, strip 6 has advanced one step in the longitudinal direction so that it is finally brought to the configuration of FIG. 1.

Of course, the invention is not limited to the example of embodiment that has just been described, this tool on the contrary being able to be made in numerous equivalent forms. For example, cylinders 36, 21 and 24 could be replaced by repulsion springs, and springs 35 can be replaced by one or more cylinders.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A follow-on tool for a stamping press having a press table and a press slide, said tool comprising for each unit stamping station of said stamping press:

a punch carried by an upper base plate which is fastened to the press slide;

a lower base plate fastened to the press table, said lower base plate including a plate member for receiving a die and at least one vertical stamping orifice;

a first support means, for supporting a prestamped metal strip, having a retractable piston member located in said vertical stamping orifice and positioned to extend above said plate member to engage a bottom portion of such prestamped metal strip when such strip is plumb with said punch and said stamping orifice and elastic means for maintaining said piston in such extended position above said plate member;

a second support means having first and second rod members extending above said plate member on opposed sides of said die and stamping orifice for engaging such prestamped metal strip at a second and third location when said strip is engaged by such first support means, said first and second rod members being elastically supported in the extended position and vertically retractable into said plate member;

an intermediate rigid plate member positioned for vertical movement between said upper base plate and said prestamped strip, said rigid plate member being engaged between a first stop and a second stop, which stops are located to allow said intermediate plate member to move vertically between said upper base plate and said prestamped strip between said stops, said rigid member including a resilient means for maintaining said rigid plate member positioned against said first stop located adjacent said upper base plate and a resilient engagement member fixed between said rigid plate member and said upper base plate to maintain spacing between said upper base plate and said rigid plate during the downward stroke of said punch until said rigid plate member engages said second stop adjacent said prestamped strip, said rigid plate member further including a centering tube having an orifice aligned with said punch and through which said punch is passed in its downward vertical stroke and a first push rod and a second push rod vertically aligned with said first and second rod members respectively for engaging said rod members and pushing said rod members against such elastic support into engagement with said plate member;

wherein said prestamped strip is supported by said first and second support means as said upper base plate, said punch, and said rigid plate begin to descend vertically until said rigid plate engages said second stop and said centering tube engages said prestamped strip and said first and second push rods have pressed said first and second support rods into engagement with said plate member, said punch continuing its downward descent to press the prestamped strip into said die and stamping orifice thereby causing said piston to retract downwardly against said elastic means, and wherein as said punch retracts from said stamping orifice it removes such stamped strip from said die thereby allowing said piston member and said first and second rod members to extend fully above said plate member and such stamped strip engages said centering tube and first and second push rods and is extracted from said punch as said punch continues to retract upward.

2. The follow-on tool according to claim 1, wherein said piston member located in the stamping orifice, is hollow and constitutes the body of a single-action cylinder having a chamber in communication, by means of an orifice, with a space located under said piston fed compressed fluid

3. The follow-on tool according to claim 1, wherein said second support means further consists of horizontal and longitudinal bars which are mounted at the free ends of said rod members, arranged in the body of said lower base plate.

4. The follow-on tool according to claim 3, wherein said lower base plate is provided with longitudinal notches able to serve as housings for said bars when said bars are in a low position.

* * * * *